US010462556B2

(12) United States Patent
Meehan et al.

(10) Patent No.: US 10,462,556 B2
(45) **Date of Patent: *Oct. 29, 2019**

(54) SPEAKER CABINET

(71) Applicant: Vivid Amps Inc., Moscow, ID (US)

(72) Inventors: Michael Denis Meehan, Moscow, ID (US); Kenneth Warren Darby, Moscow, ID (US)

(73) Assignee: Vivid Amps Inc., Moscow, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/156,543

(22) Filed: Oct. 10, 2018

(65) Prior Publication Data

US 2019/0052955 A1 Feb. 14, 2019

Related U.S. Application Data

(63) Continuation of application No. 15/428,212, filed on Feb. 9, 2017, now Pat. No. 10,104,468, which is a continuation of application No. 14/801,038, filed on Jul. 16, 2015, now Pat. No. 9,571,909.

(60) Provisional application No. 62/034,079, filed on Aug. 6, 2014.

(51) Int. Cl.
*H04R 1/02* (2006.01)
*H04R 1/28* (2006.01)

(52) U.S. Cl.
CPC ..... *H04R 1/2857* (2013.01); *H04R 1/02* (2013.01); *H04R 1/025* (2013.01); *H04R 1/288* (2013.01); *H04R 1/023* (2013.01); *H04R 2201/029* (2013.01)

(58) Field of Classification Search
CPC ..... H04R 1/28; H04R 1/2869; H04R 1/2873; H04R 1/2876
USPC ..... 381/345–347, 353–354
See application file for complete search history.

(56) References Cited

U.S. PATENT DOCUMENTS

| | | | |
|---|---|---|---|
| 3,430,728 | A | 3/1969 | Dunning |
| 3,804,195 | A | 4/1974 | Croup et al. |
| 4,109,983 | A | 8/1978 | Kinoshita |
| 4,811,403 | A | 3/1989 | Henricksen et al. |
| 5,218,176 | A | 6/1993 | Meyer, Jr. |
| 5,519,178 | A | 5/1996 | Ritto et al. |
| 5,949,033 | A | 9/1999 | Anagnos |
| 6,206,999 | B1 | 3/2001 | Ritto et al. |
| 6,719,092 | B1 | 4/2004 | Barbetta |
| 6,808,044 | B1 | 10/2004 | Barbetta |

(Continued)

FOREIGN PATENT DOCUMENTS

WO 2013137821 A1 9/2013

OTHER PUBLICATIONS

Wikipedia, "Batten", "retrieved Jun. 24, 2014 from http://en.eikipedia.org/wiki/Batten", Jun. 25, 2014, pp. 1-3, Publisher: Wikipedia, Published in: US.

(Continued)

*Primary Examiner* — Suhan Ni
(74) *Attorney, Agent, or Firm* — Fogg & Powers LLC

(57) ABSTRACT

Speaker Cabinets are provided. In one embodiment, a speaker cabinet comprises: a core fabricated from a core material, the core material having an inner chamber defining an air cavity internal to the core; a baffle board having an internal side and an external side, wherein the internal side is mounted to the core at an opening to the air cavity; and a plurality of baffle board sonic coupling battens extending from the baffle board into the core material of the core.

20 Claims, 11 Drawing Sheets

(56) References Cited

U.S. PATENT DOCUMENTS

| | | | |
|---|---|---|---|
| 6,913,110 | B1 | 7/2005 | Ritto |
| 7,337,874 | B1 | 3/2008 | Ritto |
| 7,661,508 | B1 | 2/2010 | Ritto |
| 8,083,024 | B1 | 12/2011 | Ritto |
| 9,571,909 | B2 | 2/2017 | Meehan et al. |
| 10,104,468 | B2 | 10/2018 | Meehan et al. |
| 2009/0200102 | A1 | 8/2009 | Gilbert |

OTHER PUBLICATIONS

U.S. Patent and Trademark Office, "Interview Summary", U.S. Appl. No. 14/801,038, dated Dec. 14, 2016, pp. 1-2, Published: US.
U.S. Patent and Trademark Office, "Notice of Allowance", U.S. Appl. No. 14/801,038, dated Nov. 2, 2016, pp. 1-5, Published: US.
U.S. Patent and Trademark Office, "Notice of Allowance", U.S. Appl. No. 15/428,212, dated Jul. 20, 2018, pp. 1-12, Published: US.
U.S. Patent and Trademark Office, "Office Action", U.S. Appl. No. 14/801,038, dated Jul. 28, 2016, pp. 1-11, Published: US.
U.S. Patent and Trademark Office, "Office Action", U.S. Appl. No. 15/428,212, dated Mar. 2, 2018, pp. 1-4, Published: US.
U.S. Patent and Trademark Office, "Supplemental Notice of Allowability", U.S. Appl. No. 14/801,038, dated Dec. 2, 2016, pp. 1-5, Published: US.
U.S. Patent and Trademark Office, "Supplemental Notice of Allowability", U.S. Appl. No. 14/801,038, dated Dec. 9, 2016, pp. 1-3, Published: US.

SPEAKER CABINET

CROSS-REFERENCE TO RELATED APPLICATIONS

This application is a Continuation Application claiming priority to, and the benefit of, U.S. patent application Ser. No. 15/428,212 entitled "SPEAKER CABINET" filed on Feb. 9, 2017, which claims priority to, and the benefit of, U.S. patent application Ser. No. 14/801,038 entitled "SPEAKER CABINET" filed on Jul. 16, 2015, which claims priority to, and the benefit of, U.S. Provisional Patent Application No. 62/034,079 entitled "SPEAKER CABINET" filed on Aug. 6, 2014, each of which are herein incorporated by reference in their entirety.

BACKGROUND

Speaker cabinets, such as the type used in conjunction with amplifiers by musicians in recording studios or for live performances, are typically very heavy. While the speaker assembly, including the speaker driver, contributes to the heaviness of traditional speaker cabinets, the material forming the cabinet itself is also a significant contributor. With respect to the speaker drivers, lighter weight speakers are available that replace the classical ferrite driver material with relatively lightweight drivers made from rare-earth materials such as neodymium. Lighter weight cabinet designs have also been proposed that utilize foam materials in place of heavier materials such as wood or medium density fiber (MDF) boards. However, these proposed cabinet designs have suffered acoustically as compared to traditional cabinets, failing to establish resonances which were achievable from traditional cabinets.

For the reasons stated above and for other reasons stated below which will become apparent to those skilled in the art upon reading and understanding the specification, there is a need in the art for improved systems and methods for speaker cabinets.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

SUMMARY

The Embodiments of the present invention provide for light weight speaker cabinets and will be understood by reading and studying the following specification.

In one embodiment, a speaker cabinet comprises: a core fabricated from a core material, the core material having an inner chamber defining an air cavity internal to the core; a baffle board having an internal side and an external side, wherein the internal side is mounted to the core at an opening to the air cavity; and a plurality of baffle board sonic coupling battens extending from the baffle board into the core material of the core.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present invention provide novel designs for speaker cabinets that utilize baffle board sonic coupling battens to transmit acoustic energy throughout the enclosure. Foam material used in lightweight speaker cabinet designs tends to isolate sonic energy from the speaker baffle board, limiting transmission of that energy to the rest of the cabinet. That is, the transmission of the sonic energy produced by the speaker becomes considerably attenuated. To mitigate this result, the embodiments described herein utilize baffle board sonic coupling battens, which are relatively high density elements that penetrate into the relatively less dense material of the core, providing a conduit from the baffle board for further distribution of the sonic energy. For some embodiments, a modular design approach is presented for reconfigurable speaker cabinets where one or more cabinet components can be replaced by the end user in order to further tailor the sounds produced by the cabinet to meet the end user's tastes or needs.

Figure 1A:
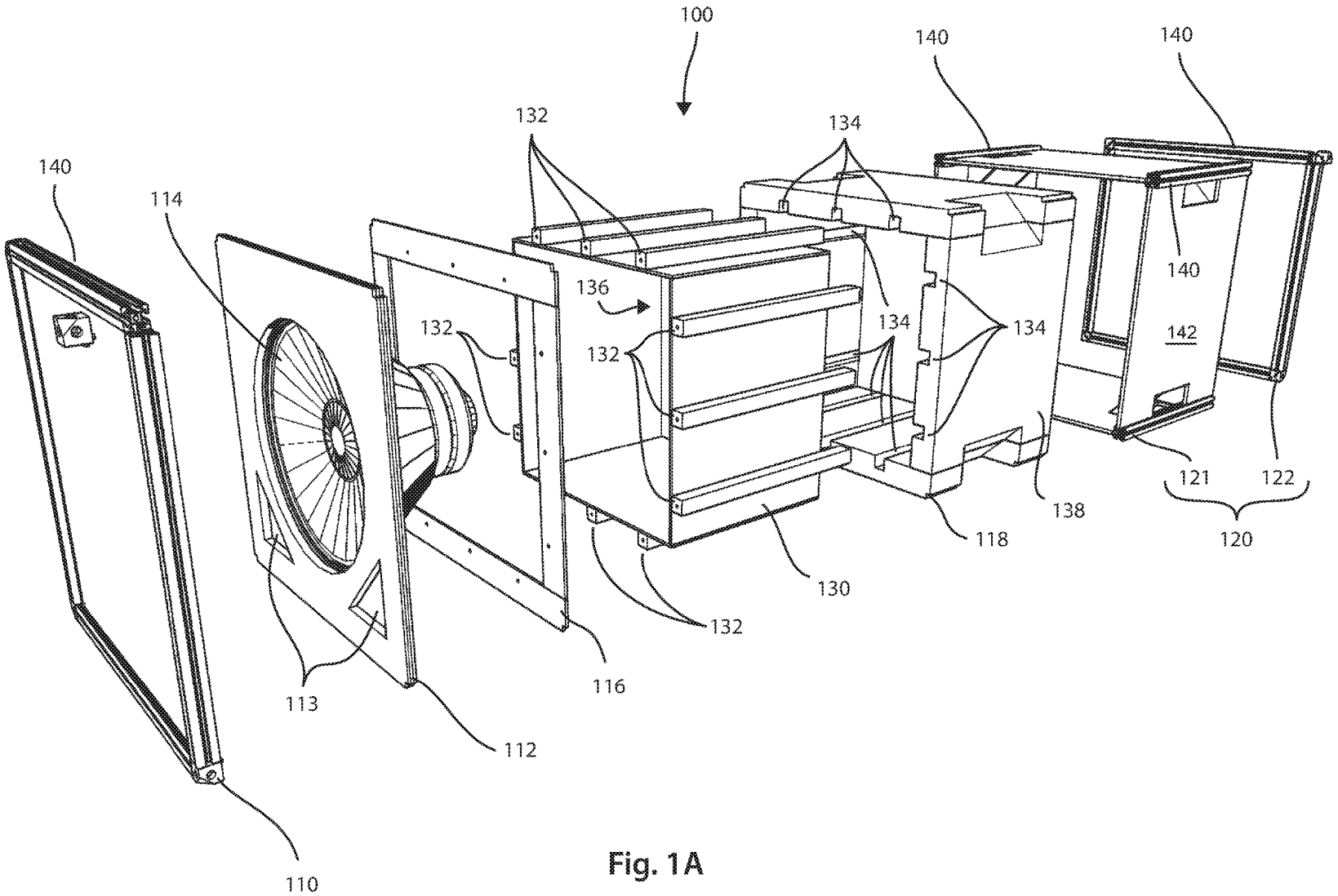
FIG. 1A is a diagram illustrating an exploded view of a speaker cabinet of one embodiment of the present disclosure.

FIG. 1A is a diagram illustrating an exploded view of a speaker cabinet 100 of one embodiment of the present disclosure. As shown in FIG. 1A, speaker cabinet 100 comprises a front grill 110, a baffle board 112 to which a speaker 114 is mounted, and an external shell 120 that includes cabinet sides 121 and back plate 122. Front grill 110 and external shell 120 are assembled together to form an enclosure that houses the baffle board 112 and speaker 114, and other internal components discussed in detail below. In the particular embodiment shown in FIG. 1A, front grill 110 and external shell 120 include a plurality of frame members 140 fabricated from extruded and machined aluminum or other alloy. The frame members 140 secure cabinet walls 142, which may be fabricated from a lightweight material such as aluminum or acrylic sheets, or other suitable lightweight material.

Within the external shell 120, cabinet 100 includes a core 118, an air cavity box 130, a plurality of baffle board sonic coupling battens 132 (also referred to herein more simply as "battens 132") and an optional decorative trim piece 116. In the particular embodiment illustrated in FIG. 1A, core 118 comprises a rigid lightweight material (such as a foam) 138 which functions as a rigid structural support element for cabinet 100. In one possible implementations, core 118 may be constructed from sheets of foam material which are cut or otherwise machined to fabricate the back and sides of core 118, bonded together with an appropriate adhesive. In other alternate implementations, core 118 may be fabricated from a foam material that is injected, sprayed or blown into a mold. Example materials which may be used for fabricating core 118 include, but are not limited to open or closed cell foams, extruded polystyrene foams, urethane foams, polyurethanes, foamed styrol, or combinations thereof, for example. The external shell 120 serves to protect the core 118 at the sides and back of the cabinet 100.

Figure 1C:
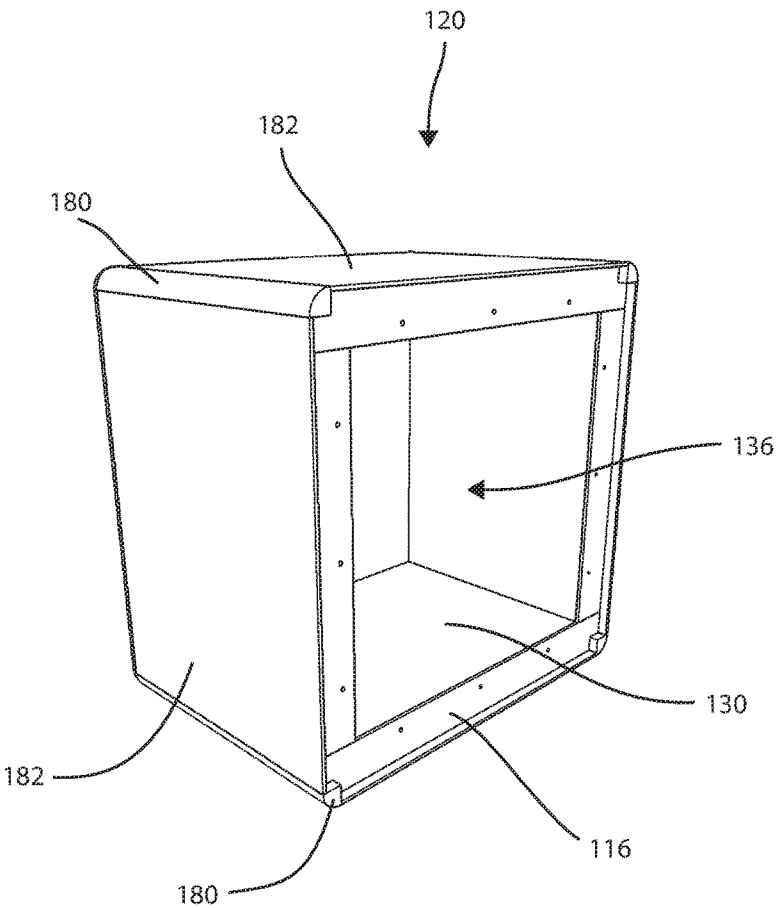
FIGS. 1B-1D are diagrams illustrating an alternate speaker cabinet of one embodiment of the present disclosure.
Figure 1B:
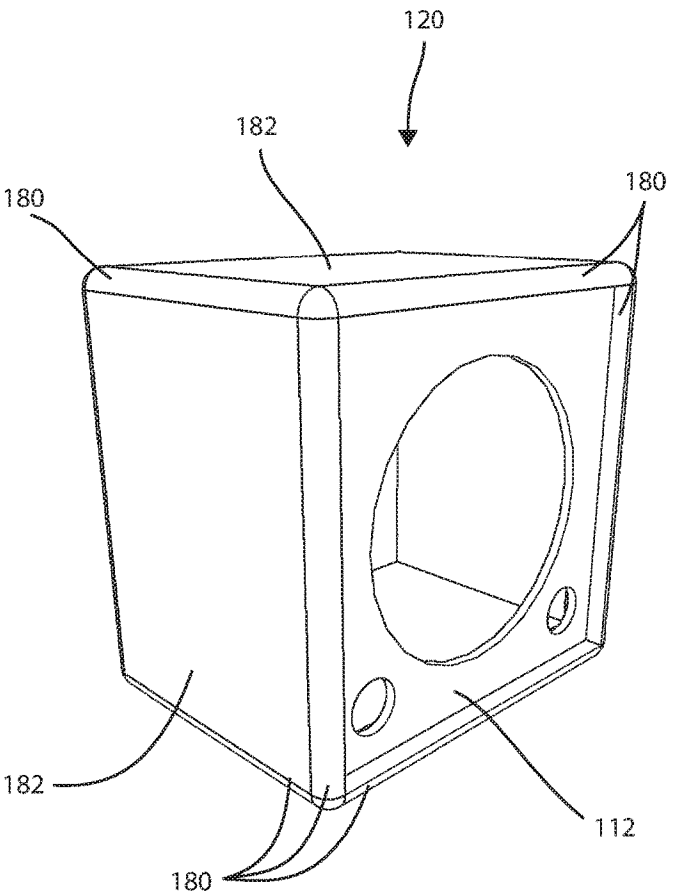
Figure 1D:
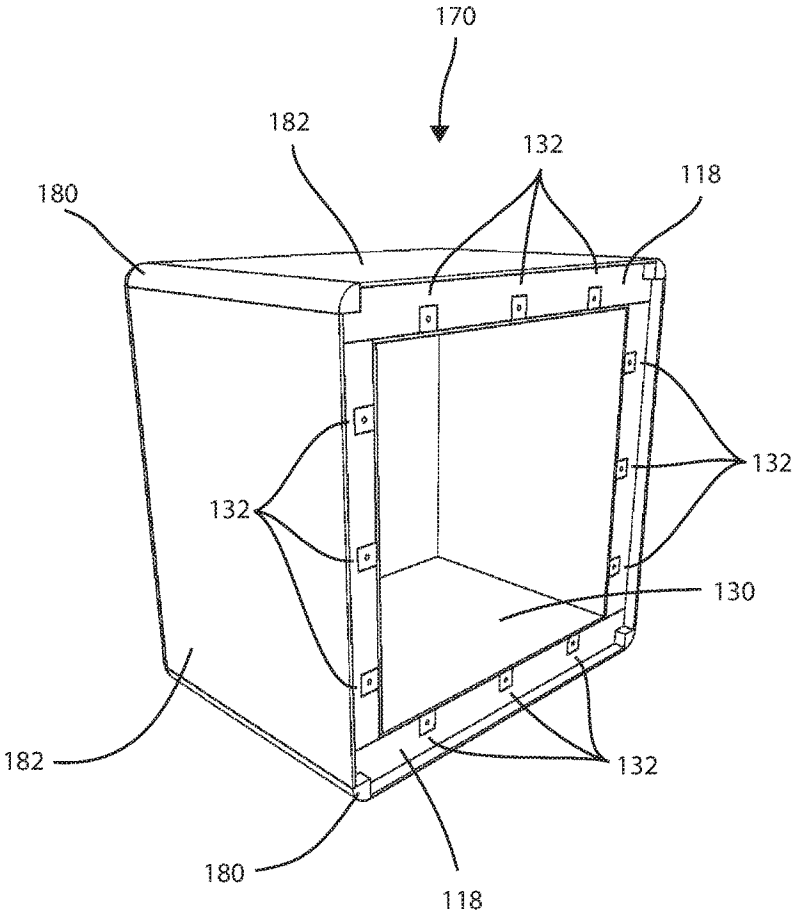

In other embodiments, such as illustrated in FIGS. 1B-1D, other materials may be used to form portions of either grill 110 or external shell 120, including, but not limited to, wood or medium density fiber (MDF) boards. For example in FIGS. 1B-1D, the external shell 120 instead comprises wooded cabinet walls 182 and frame members 180 comprised of quarter round wooded trim material. In still other embodiment, part or all of the external shell 120 may be omitted. That is, in some embodiments, the external surface of core 118 serves as the external surface of cabinet 100. In such implementations where part or all of the external shell 120 is omitted, one or more external facing surfaces of core 118 may be coated by a durable film or coating (which may be applied by a spray or dip process, for example). For example, in some embodiments, the external surface of core 118 may be coated with a 1-part or 2-part epoxy which cures to form a durable coating or laminated such as with a polyester or vinyl ester resin. In still other embodiments, an external shell around core 118 may comprise a material wrap such as a Vinyl wrap or another wrapping or heat cured shrink wrap material.

Secured within an inner chamber of the core 118, cabinet 100 may further include an air cavity box 130 defining an air cavity 136 internally within the speaker cabinet 100. In the implementation shown in FIG. 1A, the air cavity 136 is closed on all sides except where it interfaces baffle board 112 and speaker 114. However, this is not necessarily always the case. In some embodiments, air cavity box 130 may include additional openings. Further, the term "air cavity box" as used herein is not intended to be limited to cubic geometries. Instead, air cavity box 130 may be shaped and/or comprise a cavity having any arbitrary shape or number of sides. For example, one or more of the surfaces of the air cavity box 130 defining cavity 136 may be curved or have a wedge shape, or any other arbitrary shape. Air cavity box 130 may be fabricated from materials such as Masonite or Melamine boards, which provide internal surfaces for air cavity box 130 that are relatively hard and rigid. Further, air cavity box 130, or portions thereof, may be removable or replaceable with materials of varying density in order to customize or tune the acoustic qualities of cabinet 100. Some embodiments may completely omit part or all of air cavity box 130 such that air cavity 136 is defined by inner surfaces within core 118. In such cases, the material 138 at the inner surfaces of core 118 may be contoured or include features. For example, such features may include concentric slots carved in the back surface opposite to the speaker 114. For example, the back surface may comprise concentric circles carved into material 138 (e.g. having a width of ½ inch from inner diameter to outer diameter, ½ inch deep into material 138 and spaced ½ inch apart). Other surfaces of either core 118 or air cavity box 130 facing into cavity 136 may similarly include such contours or features.

Low impedance ports 113, may be optionally provided in baffle board 112. These low impedance ports 113 allow air and sound to transfer out from the air cavity 136 in response to pressure crated within the air cavity 136 by the movements of speaker 114 and baffle board 112. Further, some implementations may include a means to vary the density of the coupling between speaker 114 and baffle board 112, such as by using isolated fasteners and nuts with a selectable density speaker flange gasket.

An optional trim piece 116 may also be provided to cover exposed portions of core 118, battens 132, and the edges of air cavity box 130. In some embodiments, trim piece 116 may be purely decorative for aesthetic purposes to provide a clean appearance when the grill 110 and baffle board 112 are removed. However, in other embodiment, trim piece 116 may be selected for its density and/or acoustical properties. For example, in one implementation trim piece 116 may function as a gasket that either facilitates or attenuates coupling of acoustical energy between the baffle board 112 and core 118 or the baffle board sonic coupling battens 132.

Figure 2:
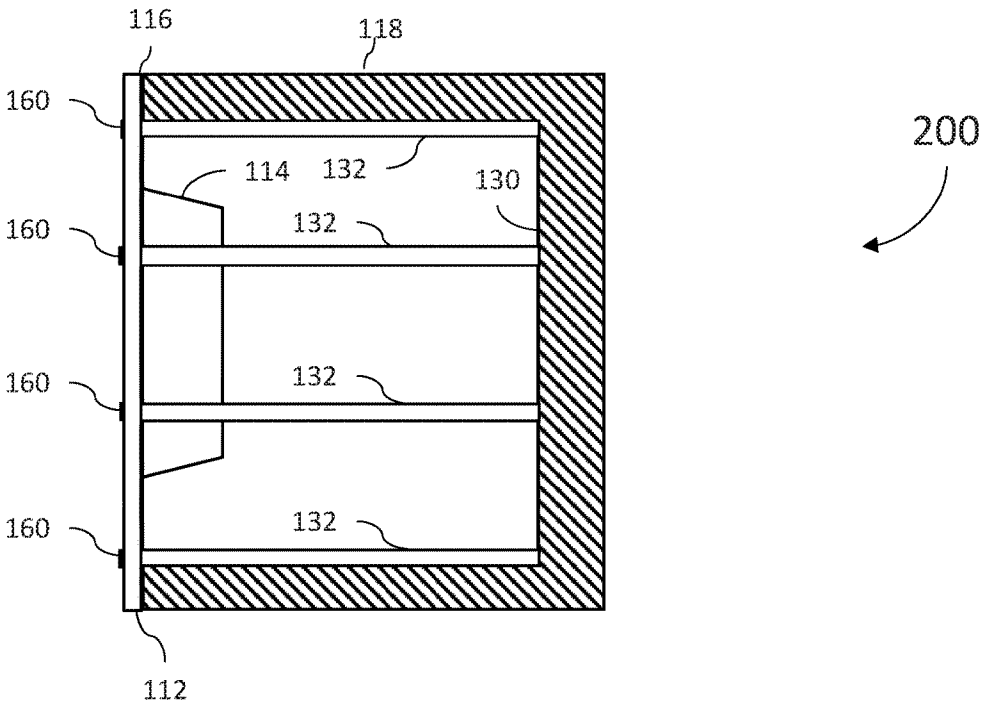
FIG. 2 is a diagram illustrating a baffle board coupled with a plurality of baffle board sonic coupling battens of one embodiment of the present disclosure.

The baffle board sonic coupling battens 132 are each solidly fastened to the baffle board 112 and extend laterally into the core 118. In different embodiments, the battens 132 may be fabricated from wooden strips or a similarly dense composite material denser than the material 138 of core 118. As illustrated generally at 200 in FIG. 2, each of the battens 132 are secured to the baffle board 112 by at least one fastener 160, which may be a screw or bolt or similar fastener that penetrates through baffle board 112 into a first end of a batten 132. Where a trim piece 116 is provided, the fastener 160 would penetrate through that material as well. In some implementations, the baffle board 112 and battens 132 are formed as an integrated one-piece element. In some implementations, baffle board 112 together with battens 132 may be a one piece molded element (for example, fabricated using injection molding).

The number, density, size and shape of the baffle board sonic coupling battens 132 may vary for different implementations of cabinet 100. For example, battens 132 may have a polygonal shaped cross section (e.g., rectangular, triangular), a curved shaped cross section (e.g., oval, circular) or some combination thereof. They may also vary in length (that is, vary in their penetration depth into core 118) so as to excite different resonances in different regions of the cabinet 100. They may also extend into core 118 with a perpendicular orientation with respect to the plane of baffle board 112, or at some acute/oblong angle with respect to the plane of baffle board 112, or have a curved shape (e.g. bowed) along their length into core 118. The battens 132 within any one cabinet may be of differing densities and may have a different density than the baffle board 112. Also, any one baffle board sonic coupling batten 132 need not have a uniform density along its length from the baffle board 112 into core 118, but may comprise a gradient in density from one end to the other. For example, the baffle board 112 will carry a significant portion of the sonic energy produced by speaker 114 and the amount of that sonic energy coupled into the baffle board sonic coupling battens 132, and from the battens 132 into the core 118, is a function of the density and any density gradient of the battens. Equalizing the distribution of sonic energy through the relatively less dense core 118, or alternately focusing sonic energy in a given region of core 118, may be achieved by tailoring the densities of each of the baffle board sonic coupling battens 132.

Figure 3B:
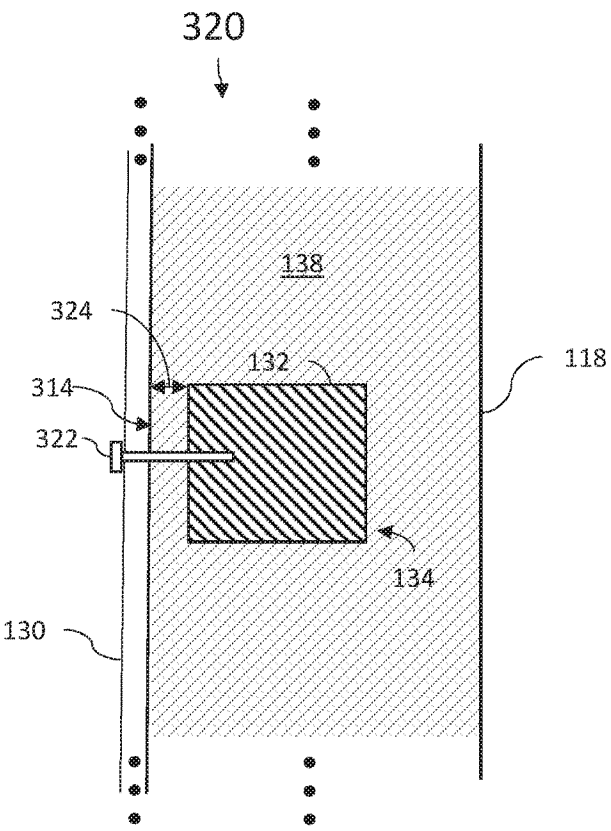
FIGS. 3A-3B are diagrams illustrating baffle board sonic coupling battens embedded within a foam core for alternate embodiments of the present disclosure.
Figure 3A:
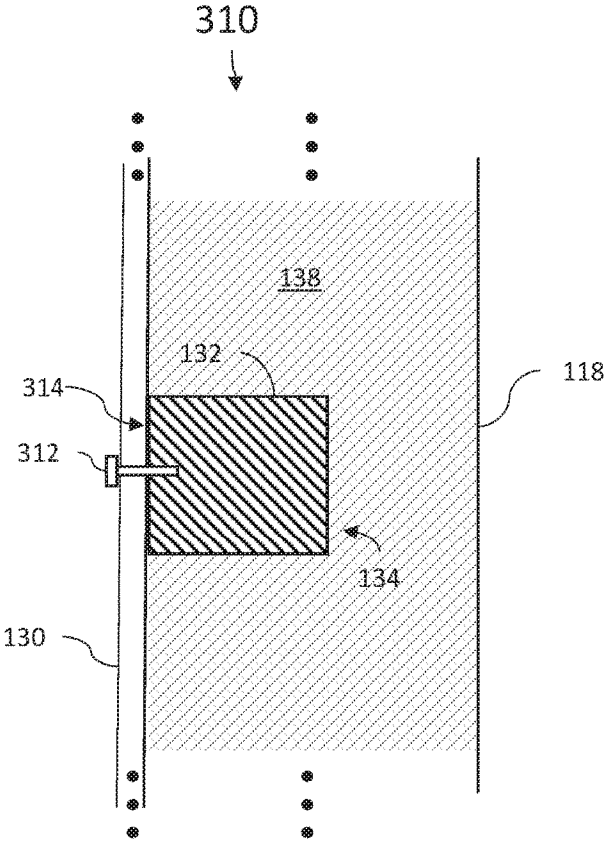

For some embodiments, the individual battens 132 are in direct contact with the air cavity box 130, as illustrated in FIG. 1A, and as also shown in FIG. 3A generally at 310. In this case, the foam material 138 of core 118 includes longitudinal slots 134 on the internal surface of the foam material 138 which run from the front towards the back of core 118 and accommodate the battens 132. The battens 132 installed in slots 134 may optionally be held in place by an adhesive. Further, cavity box 130 may be rigidly secured to the battens 132, by a fastener 312, which may be a screw or bolt or similar fastener. In operation, sonic vibrations are coupled into each of the battens 132 from the baffle board 112 and transmitted deep into the back of the air cavity box 130. In this embodiment, the direct contact between air cavity box 130 and battens 132 (shown at interface 314) permits a direct coupling of vibrations from the battens to the air cavity box.

In other embodiments, as shown in FIG. 3B generally at 320, the battens 132 are embodied within the foam material 138 of core 118. In this case, the slots 134 form tunnels within the foam material 138 which run from the front towards the back of core 118 and accommodate the battens 132. The air cavity box 130 may still be secured to the battens 132, by a fastener 322 (which may be a screw or bolt or similar fastener) that penetrates through the foam material 138 to reach the batten 132. In operation, sonic vibrations are still coupled into each of the battens 132 from the baffle board 112 and transmitted to the air cavity box 130. However, there will be some dampening of the transmission of sonic vibrations from the battens 132 to the air cavity box 130 that varies as a function of the distance 324 between them, and the relative density of the foam material 138. The length of the battens 132 with respect to the depth of the air cavity box may vary from implementation to implementation. In some embodiments, one or more of the battens 132 may penetrate into the core 118 less than, as far as, or past the back of the air cavity box 130, and in some cases, penetrate completely through to the back of core 118.

In some implementations, core 118 has slots 134 prefabricated within the material 138 of core 118 and the appropriate corresponding battens 132 are inserted into those slots 134. In other implementations, core 118 is instead overmolded over the battens 132. That is, the battens 132 (either with or without baffle board 112) are inserted into a mold and the core material 138 is poured or otherwise injected around the battens 132. Once the core material 138 cures, the battens are essentially embedded within the material 138.

Figure 3D:
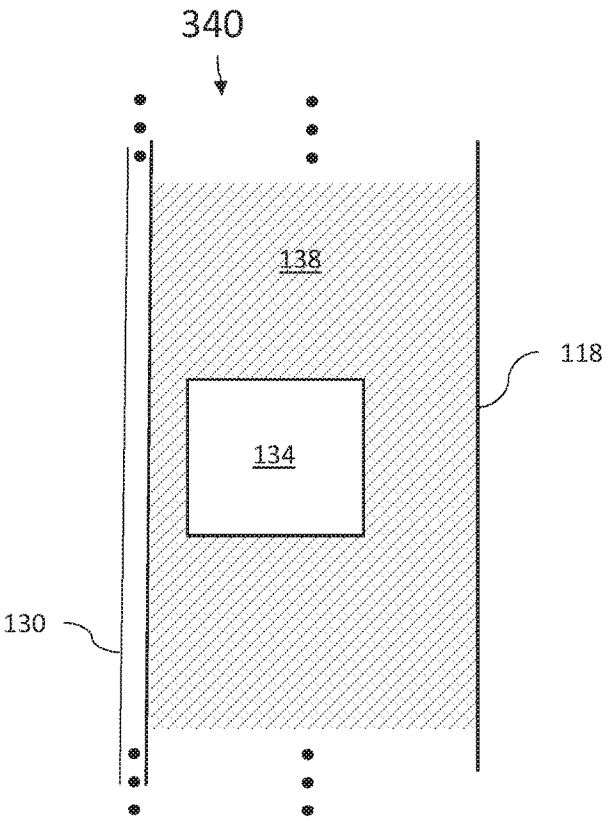
FIGS. 3C-3D are diagrams illustrating air slots within a foam core for alternate embodiments of the present disclosure.
Figure 3C:
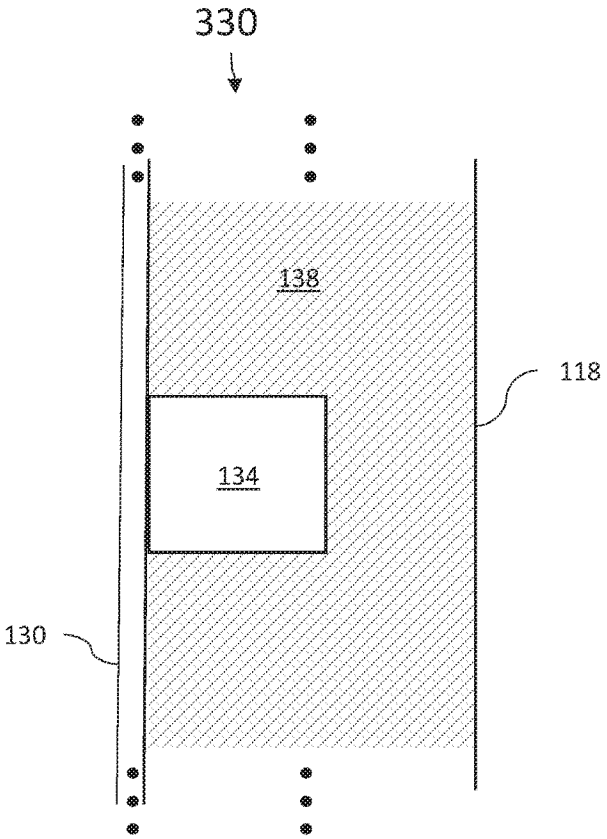
Figure 3E:
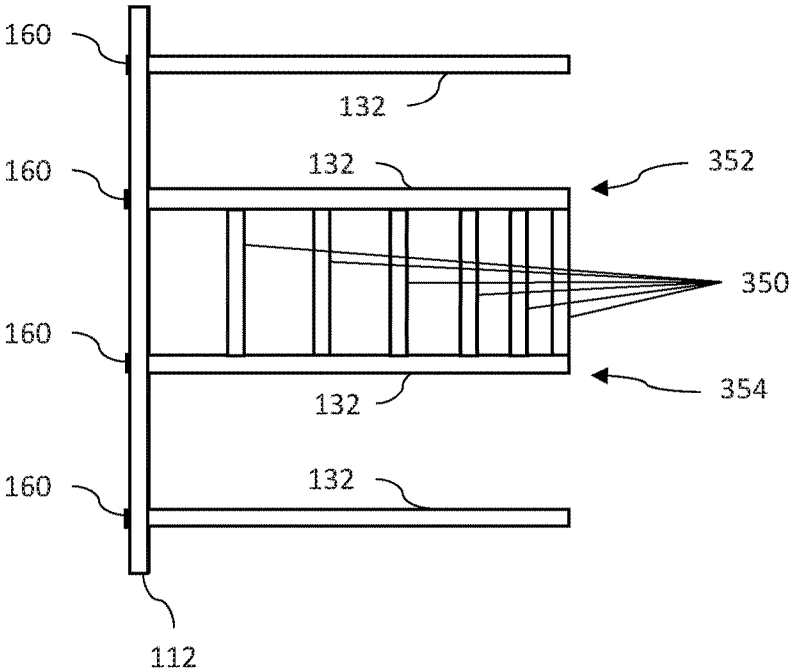
FIG. 3E is a diagram illustrating cross battens utilized between a pair of baffle board sonic coupling battens.

In still other embodiments, one or more of the slots 134 within the material 138 of core 118 may remain as air slots or open voids such as shown generally in FIG. 3C at 330 and FIG. 3D at 340. For example, in one embodiment a cabinet may comprise an unused or open slot 134 between slots containing battens 132 in order to tune or alter sonic performance. In some embodiments, existing battens 132 may be removed from core 118 to configure cabinet 100 with an open slot 134. In other embodiments, a batten 132 may be dimensioned to only partially fill a slot (either in length or width) so that the balance of the slot remains open. In still other potential implementations, two or more battens 132 may be physically tied together within core 118, either directly or through additional batten material, to provide a low impedance path for sound vibration between them. For example, as shown in FIG. 3E, one or more cross battens 350 tie a first batten 132 (shown at 352) with a second batten 132 (shown at 354). When more than one cross batten 350 is utilized in this manner, they may be evenly spaced along the length of the battens 132, or alternatively non-uniformly spaced. For example, in one implementation, a set of cross battens 350 has logarithmic spacing with each batten getting closer as a function of distance from the baffle board 112. Such utilization of cross battens 350 provides yet another tuning method to tailor the acoustical properties of cabinet 100.

Figure 4:
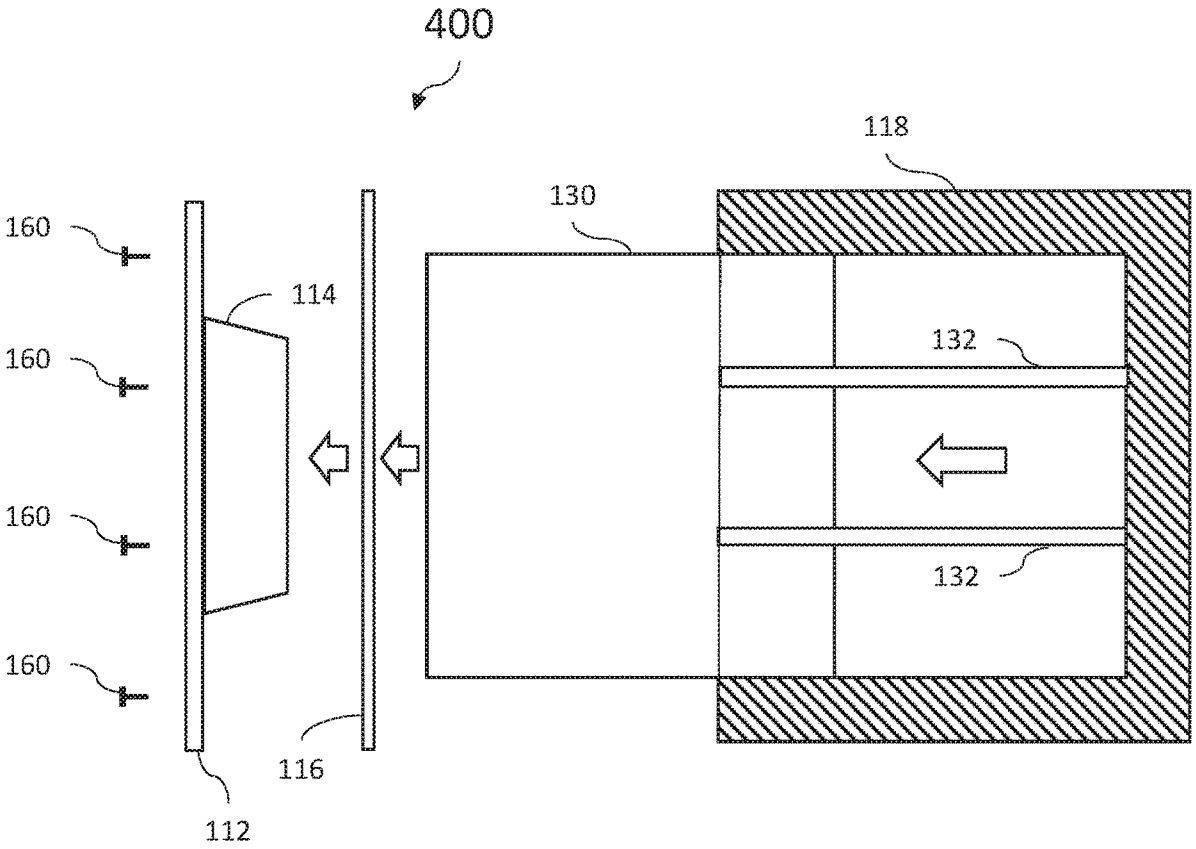
FIG. 4 is a diagram illustrating the modular configurability of a speaker cabinet of one embodiment of the present disclosure.
Figure 5:
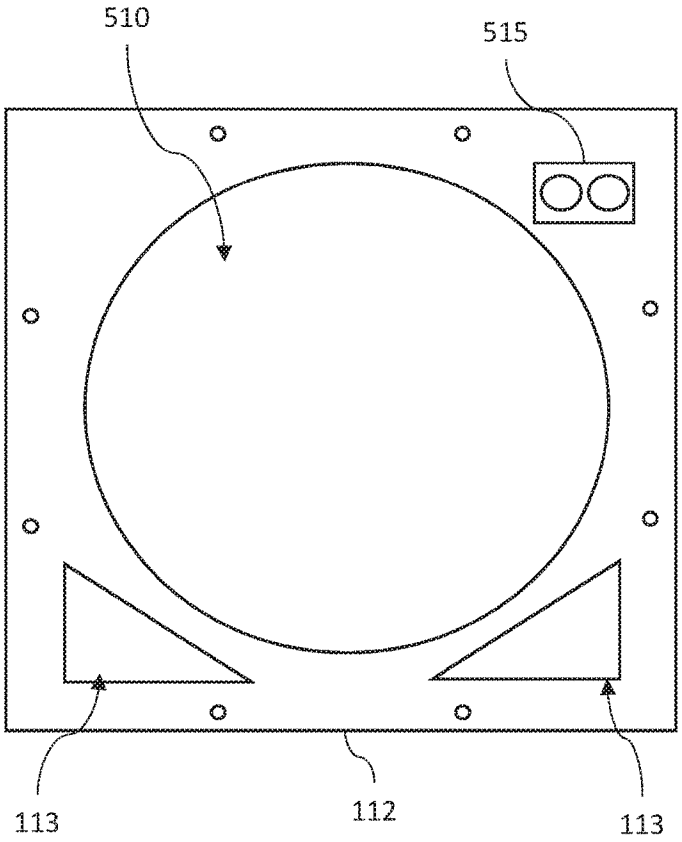
FIG. 5 is a diagram illustrating a baffle board for use with embodiments of the present disclosure.

As mentioned above, and illustrated in FIG. 4 generally at 400, some implementations of cabinet 100 are modular in design. Removal of fasteners 160 permits removal of the baffle board 112 and speaker 114 so that these elements may be changed out as desired by the consumer. For example, if the consumer desired to change out the speaker 114, from a 12 inch diameter speaker to a 10 inch diameter speaker, they may simply unfasten the baffle board 112 with the 12 inch speaker from the battens 132, and refasten a new baffle board 112 having the 10 inch speaker. For example, referring to FIG. 5, by changing out the baffle board 112, various configurations can be accommodated. As just mentioned, replacement baffle boards can provide different diameter speaker ports 510 sized for the speaker 114 that the consumer wishes to use. In addition low impedance ports 113 may be provided in different sizes, shapes, or numbers, depending on the sound the consumer is trying to achieve. In some embodiments, a baffle board 112 may come without low impedance ports. In still other embodiments, a baffle board 112 may come with, or support installation of, one or more controls 515 (such as a potentiometer, for example). For example, in some implementations, speaker 114 may comprise a driver that incorporates a compression tweeter. In that case, controls 515 may comprise a potentiometer mounted to the baffle board 112 and wired to the tweeter within cavity 136 to provide a separate volume control for the tweeter. Also as illustrated in FIG. 4, for some embodiments, trim piece 116 and the air cavity box 130 are also replaceable elements. For example, one air cavity box 130 can be replaced by another fabricated from another material (which may be relatively harder or softer that the one it replaces), of differing surface texture, or other variation. For implementations where air cavity box 130 is not intended to be removable, it may be affixed to the core 118 and/or battens 132 by an adhesive material.

Figure 6:
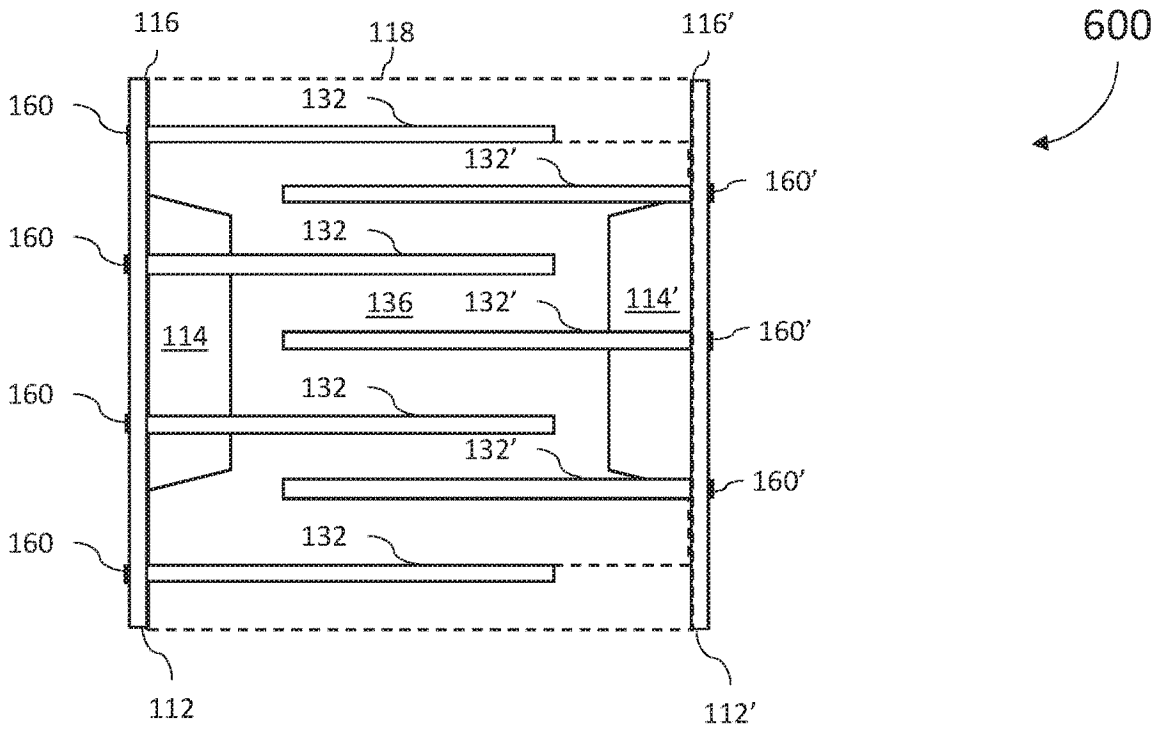
FIG. 6 is a diagram illustrating a two-speaker implementation of a speaker cabinet of one embodiment of the present disclosure.

FIG. 6 illustrates yet another embodiment of cabinet 100, generally at 600, which facilitates a second speaker 114' and baffle board 112' coupled to a second set of baffle board sonic coupling battens 132'. In the particular configuration shown at 600, cabinet 100 is configured so that the second speaker 114' is a back-firing speaker from the rear of cabinet 100. However, in other embodiments, speaker 114' may instead be positioned as a side, upward, or downward firing speaker. Accordingly, core 118 and/or air cavity box 130 are configured with at least one additional opening so that speakers 114 and 114' share the air cavity 136. As with any of the embodiments illustrated above, baffle board sonic coupling battens 132' penetrate into the material 138 of core 118 in the same manner as any implementation of the battens 132 described above. The baffle board 112' is secured to the battens 132' by a plurality of fasteners 160' and this embodiment may include a trim piece 116'. Any of these elements may be varied in the same manner as described with respect to their corresponding elements discussed in the Figures above.

It should also be appreciated that cabinet 100, in addition to being solely a speaker cabinet may be implemented in combination with an integrated amplifier or additional electronics or signal processors. The addition electronics may include, for example, wireless connectivity that provides for wireless control of cabinet electronics as well as for wireless reception of the audio signal. Such wireless connectivity may be implemented using Bluetooth, Wi-Fi, or other wireless technology. Also, cabinet 100 may comprise any overall shape or contoured design, or incorporate other design elements without deviating from the contemplated scope of embodiments of the present invention. For example, spherical or wedged shaped cabinets, in addition to more traditional cubical shaped cabinets, are contemplated. The overall form factor of cabinet 100 may be customized to be made suitable for in-wall construction as well as car, aircraft and boat installations.

Figure 7:
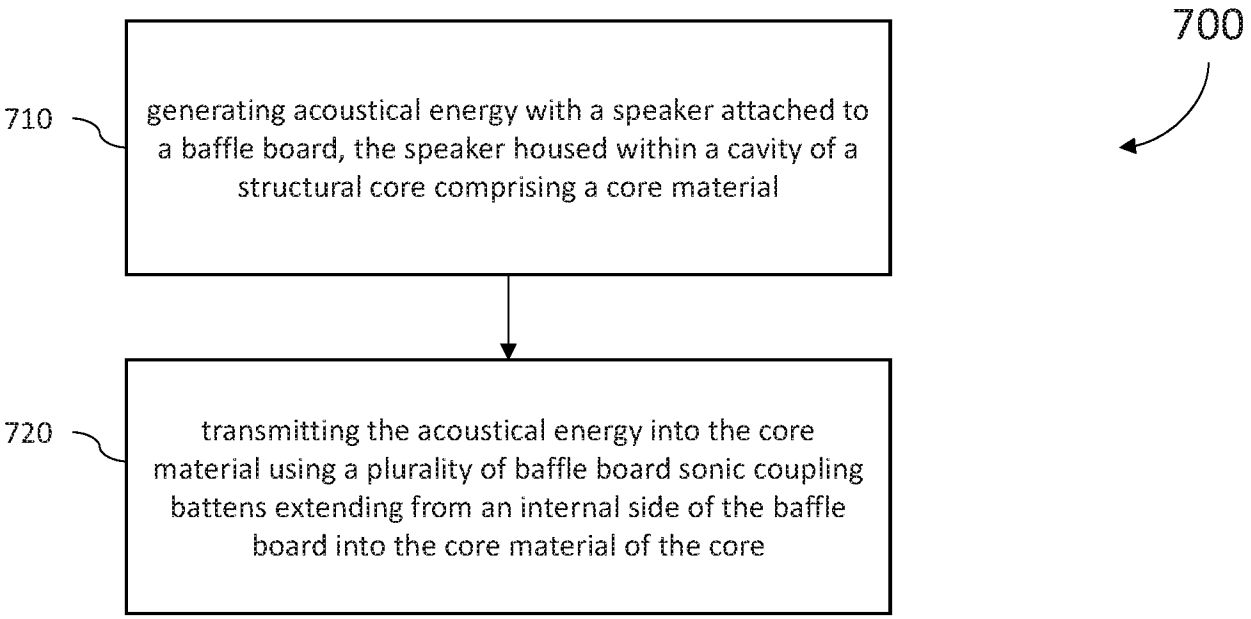
FIG. 7 is a flow chart illustrating a method of one embodiment of the present disclosure.

FIG. 7 is a flow chart illustrating a method 700 of one embodiment of the present disclosure for producing sound from a speaker. It should be appreciated that implementations of method 700 may be used in conjunction with, and in combination with, any of the above describe embodiments and implementations, either in whole or in part. The method begins at 710 with generating acoustical energy with a speaker attached to a baffle board, the speaker housed within a cavity of a structural core comprising a core material. For example, such a combination of a speaker, baffle board and structural core is illustrated with respect to FIGS. 1, 4 and 6. The method proceeds to 720 with transmitting the acoustical energy into the core material using a plurality of baffle board sonic coupling battens extending from an internal side of the baffle board into the core material of the core. The baffle board sonic coupling battens penetrate into the core material, providing a conduit from the baffle board for further distribution of the sonic energy deep into the cavity housing the speaker. In one embodiment, the method may further comprise coupling the acoustical energy into an air cavity box within the cavity.

In some implementations, the air cavity box may directly contact one or more of the plurality of baffle board sonic coupling battens, such as shown in FIG. 3A. In other implementations, the air cavity box is acoustically coupled to one or more of the plurality of baffle board sonic coupling battens by at least one fastener that penetrates through a layer of the core material that separates the air cavity box from the one or more of the plurality of baffle board sonic coupling battens, such as shown in FIG. 3B. The core material may comprise a foam material such as, but not limited to: a structural foam material; an open cell foam material; an extruded polystyrene foam material; a urethane foam material; a polyurethane material; or a foamed styrol material, or a combination thereof. Further the core material may itself be enclosed within an external shell.

EXAMPLE EMBODIMENTS

Example 1 includes a speaker cabinet, the speaker cabinet comprising: a core fabricated from a core material, the core material having an inner chamber defining an air cavity internal to the core; a baffle board having an internal side and an external side, wherein the internal side is mounted to the core at an opening to the air cavity; and a plurality of baffle board sonic coupling battens extending from the baffle board into the core material of the core.

Example 2 includes the speaker cabinet of example 1, wherein one or more of the plurality of baffle board sonic coupling battens are fastened to the baffle board by a fastener.

Example 3 includes the speaker cabinet of any of examples 1-2, wherein one or more of the plurality of baffle board sonic coupling battens extend into a respective slot formed within the core material of the core.

Example 4 includes the speaker cabinet of any of examples 1-3, further comprising: an external shell, wherein the core is housed within the external shell.

Example 5 includes the speaker cabinet of example 4, wherein the external shell comprises at least one of: an extruded metal frame; an aluminum material; an acrylic material; a wood material; or a medium density fiber (MDF) material.

Example 6 includes the speaker cabinet of any of examples 1-5, wherein the core material comprises at least one of: a structural foam material; an open cell foam material; an extruded polystyrene foam material; a urethane foam material; a polyurethane material; or a foamed styrol material.

Example 7 includes the speaker cabinet of any of examples 1-6, further comprising: a grill configured to externally mount over the baffle board.

Example 8 includes the speaker cabinet of any of examples 1-7, further comprising a speaker mounted to the baffle board.

Example 9 includes the speaker cabinet of any of examples 1-8, wherein the plurality of baffle board sonic coupling battens are fastened to the baffle board with removable fasteners.

Example 10 includes the speaker cabinet of any of examples 1-9, further comprising: an air cavity box positioned within the inner chamber of the core, wherein the air cavity is further defined within the air cavity box.

Example 11 includes the speaker cabinet of example 10, wherein the air cavity box comprises at least one curved surface.

Example 12 includes the speaker cabinet of any of examples 10-11, wherein the air cavity box is secured to one or more of the plurality of baffle board sonic coupling battens using removable fasteners.

Example 13 includes the speaker cabinet of any of examples 10-12, wherein the air cavity box is separated from the plurality of baffle board sonic coupling battens by a portion of the core material.

Example 14 includes the speaker cabinet of any of examples 10-13, wherein one or more of the plurality of baffle board sonic coupling battens are in direct physical contact with the air cavity box.

Example 15 includes the speaker cabinet of any of examples 1-14, wherein at least one of the plurality of baffle board sonic coupling battens is shorter than another of the plurality of baffle board sonic coupling battens.

Example 16 includes the speaker cabinet of any of examples 1-15, wherein at least one of the plurality of baffle board sonic coupling battens extend to penetrate into the core material at least as far as a depth of the air cavity box.

Example 17 includes an audio electronics cabinet, the cabinet comprising: a core fabricated from a first material; an air cavity box fabricated from a second material and positioned internal to the core, the air cavity box having at least a first internal surface that defines an internal air cavity; a plurality of baffle board sonic coupling battens interfacing with an exterior of the air cavity box, the plurality of baffle board sonic coupling battens embedded within the core material, the air cavity box comprising at least a first opening to the air cavity; and a baffle board mounted to the core over the first opening to the air cavity box, wherein the plurality of baffle board sonic coupling battens extend from the baffle board.

Example 18 includes the cabinet of example 17, wherein one or more of the plurality of baffle board sonic coupling battens are fastened to the baffle board by a fastener.

Example 19 includes the cabinet of any of examples 17-18, wherein one or more of the plurality of baffle board sonic coupling battens extend into a respective slot formed within the first material of the core.

Example 20 includes the cabinet of any of examples 17-19, wherein the first material comprises at least one of: a structural foam material; an open cell foam material; an extruded polystyrene foam material; a urethane foam material; a polyurethane material; or a foamed styrol material.

Example 21 includes the cabinet of any of examples 17-20, wherein the plurality of baffle board sonic coupling battens each comprise at least one of: a wood material; a dense composite material.

Example 22 includes the cabinet of any of examples 17-21, wherein the second material comprise at least one of: a Masonite material; or a Melamine material.

Example 23 includes the cabinet of any of examples 17-22, further comprising a speaker mounted to the baffle board.

Example 24 includes the cabinet of any of examples 17-23, the air cavity box further comprising a second opening to the air cavity; and a second baffle board mounted to the core over the second opening to the air cavity box, wherein a second plurality of baffle board sonic coupling battens are fastened to the second baffle board.

Example 25 includes the cabinet of example 24, further comprising a second speaker mounted to the second baffle board, wherein at least part of the second speaker extends into the air cavity.

Example 26 includes a method for producing sound from a speaker, the method comprising: generating acoustical energy with a speaker attached to a baffle board, the speaker housed within a cavity of a structural core comprising a core material; and transmitting the acoustical energy into the core material using a plurality of baffle board sonic coupling battens extending from an internal side of the baffle board into the core material of the core.

Example 27 includes the method of examples 26, wherein one or more of the plurality of baffle board sonic coupling battens are fastened to the baffle board by a fastener.

Example 28 includes the method of any of examples 26-27, wherein one or more of the plurality of baffle board sonic coupling battens extend into a respective slot formed within the core material of the core.

Example 29 includes the method of any of examples 26-28, further comprising: coupling the acoustical energy into an air cavity box within the cavity.

Example 30 includes the method of any of examples 26-29, wherein the air cavity box directly contacts one or more of the plurality of baffle board sonic coupling battens.

Example 31 includes the method of any of examples 26-30, wherein the air cavity box is acoustically coupled to one or more of the plurality of baffle board sonic coupling battens by at least one fastener that penetrates through a layer of the core material that separates the air cavity box from the one or more of the plurality of baffle board sonic coupling battens.

Example 32 includes the method of any of examples 26-31, wherein the core material comprises a foam material.

Example 33 includes the method of example 32, wherein the foam material comprises at least one of: a structural foam material; an open cell foam material; an extruded polystyrene foam material; a urethane foam material; a polyurethane material; or a foamed styrol material.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A speaker cabinet, the speaker cabinet comprising:

a core fabricated from a core material, the core material having an inner chamber defining an air cavity internal to the core, the core material comprising a plurality of slots that form tunnels within the core material and which run from a front of the core towards a back of core;

an integrated one-piece element that includes a baffle board and a plurality of baffle board sonic coupling battens, the baffle board having an internal side and an external side, wherein the plurality of baffle board sonic coupling battens extend from the internal side of the baffle board;

wherein the each of the plurality of slots are positioned within the core to align with and receive a respective one of the plurality of baffle board sonic coupling battens;

wherein the internal side of the baffle board is mounted to the core at an opening to the air cavity.

2. The speaker cabinet of claim 1, wherein at least one of the plurality of baffle board sonic coupling battens only partially fills a respective slot of the plurality of slots into which it is inserted.

3. The speaker cabinet of claim 1, wherein at least one of the plurality of baffle board sonic coupling battens comprise a gradient in density from a first end to a second end.

4. The speaker cabinet of claim 1 further comprising a second plurality of slots that form tunnels within the core material and which run from a front of the core towards a back of core, wherein the second plurality of slots remain as open voids.

5. The speaker cabinet of claim 1, wherein the integrated one-piece element is a one-piece molded element.

6. The speaker cabinet of claim 1, further comprising:

an air cavity box positioned within the inner chamber of the core, wherein the air cavity is further defined within the air cavity box.

7. The speaker cabinet of claim 6, wherein the cavity box is rigidly secured to the plurality of baffle board sonic coupling battens by at least one fastener.

8. The speaker cabinet of claim 6, wherein the cavity box is in direct contact with at least one of the plurality of baffle board sonic coupling battens.

9. The speaker cabinet of claim 1, further comprising:

an external shell, wherein the core is housed within the external shell.

10. The speaker cabinet of claim 9, wherein the external shell comprises at least one of:

an extruded metal frame;

an aluminum material;

an acrylic material;

a wood material; or a medium density fiber (MDF) material.

11. The speaker cabinet of claim 1, wherein the core material comprises at least one of:

a structural foam material;

an open cell foam material;

an extruded polystyrene foam material;

a urethane foam material;

a polyurethane material; or a foamed styrol material.

12. The speaker cabinet of claim 1, further comprising a speaker mounted to the baffle board.

13. The speaker cabinet of claim 1, wherein the core comprises a plurality of sheets of foam material.

14. A method for acoustically tuning a speaker cabinet, the method comprising:

providing a core of a speaker cabinet, the core fabricated from a core material having an inner chamber defining an air cavity internal to the core, the core material comprising a plurality of slots that form tunnels within the core material and which run from a front of the core towards a back of core;

inserting a plurality of baffle board sonic coupling battens into the plurality of slots, wherein a first baffle board sonic coupling batten of the plurality of baffle board sonic coupling battens differs from a second baffle board sonic coupling batten of the plurality of baffle board sonic coupling battens in either size, shape, or density;

fastening a baffle board to the plurality of baffle board sonic coupling battens an opening to the air cavity.

15. The method of claim 14, further comprising:

installing an air cavity box positioned within the inner chamber of the core.

16. The method of claim 15, further comprising:

fastening the air cavity box to at least one of the plurality of baffle board sonic coupling battens using a fastener.

17. The method of claim 14, wherein at least one of the plurality of baffle board sonic coupling battens only partially fills a respective slot of the plurality of slots into which it is inserted.

18. The method of claim 14, wherein at least one of the plurality of baffle board sonic coupling battens comprise a gradient in density from a first end to a second end.

19. The method of claim 14, further comprising a second plurality of slots that form tunnels within the core material and which run from a front of the core towards a back of core, wherein the second plurality of slots remain as open voids.

20. The method of claim 14, further comprising mounting a speaker to the baffle board.

* * * * *